US005984440A

United States Patent [19]

Watson

[11] Patent Number: 5,984,440

[45] Date of Patent: Nov. 16, 1999

[54] SOAP BAR HOLDER WITH TRAY FOR CLEANING

[76] Inventor: Elroy Watson, 6933 Borderbrook #306, San Antonio, Tex. 78238

[21] Appl. No.: 09/192,448

[22] Filed: Nov. 16, 1998

[51] Int. Cl.[6] ..... A47B 17/00

[52] U.S. Cl. ..... 312/206; 4/605; 206/77.1

[58] Field of Search ..... 248/309.1; 312/206, 312/198, 210.5, 212; 4/605, 559, 628; 206/77.1; 211/62

[56] References Cited

U.S. PATENT DOCUMENTS

| | | | |
|---|---|---|---|
| 1,211,353 | 1/1917 | Rautzenburg | 206/77.1 |
| 4,300,248 | 11/1981 | Dworkin | 4/628 |
| 4,630,794 | 12/1986 | Ross | 248/309.1 |
| 5,261,541 | 11/1993 | Li | 211/62 |
| 5,669,085 | 9/1997 | Wilson | 4/605 |

*Primary Examiner*—Ramon O. Ramirez

[57] ABSTRACT

A soap bar holder for having a plurality of compartments, each compartment being for holding a single soap bar. A removable shelf and tray further provide a means for easily cleaning the soap bar holder. The device includes a housing having a partitioned interior. The tray is slidably receivable within either one of an opening formed in a housing side wall and is designed to catch dissolved soap. The shelf is slidably receivable upon the tray and is designed to support a plurality of soap bars contained within the compartments of the partitioned housing interior.

7 Claims, 2 Drawing Sheets

SOAP BAR HOLDER WITH TRAY FOR CLEANING

BACKGROUND OF THE INVENTION

1. Field of the Invention

The present invention relates to soap bar holders and more particularly pertains to a new soap bar holder having a plurality of compartments, each compartment being for holding a single soap bar. A removable shelf and tray further provide a means for easily cleaning the soap bar holder.

2. Description of the Prior Art

The use of soap bar holders is known in the prior art. Soap bar holders are generally designed to provide access to the soap bar while keeping the soap bar from coming into contact with water, as such contact can lead to loss of soap through the dissolving action of the water upon the soap.

U.S. Pat. No. 3,054,211 describes a soap holder for supporting a cake of soap upon a base and within a retaining member. The retaining member is pivotally mounted upon the base so that the cake of soap may be retained against inadvertent movement out of the base but may easily be removed therefrom when the soap retaining member is swung laterally upon its pivot axis. An upper face of the floor portion of the base is provided with upwardly standing webs to hold the cake of soap above the tray portion of the base floor.

U.S. Pat. No. 5,156,450 discloses a portable soap caddy assembly having a toiletry receptacle for holding various toiletries and having an auxiliary receptacle with an opening and sidewalls. The auxiliary receptacle is utilized to carry bar soap.

U.S. Pat. No. 4,630,794 discloses a soap holder and dispenser wherein the soap is placed in a container through an opening in the top of the container. A pivotally connected enclosure positions the soap on a holding shelf and shelters the soap from direct and indirect contact with water. The shelf has at least one drain for allowing water to drain from the soap and not pool and collect around the soap. When soap is needed, the user pivots the enclosure which pushes the soap semiautomatically to an exit opening.

Additional soap bar holders are described and shown in U.S. Pat. No. 4,548,572 and U.S. Pat. No. Des. 359,867.

While these devices fulfill their respective, particular objectives and requirements, the aforementioned patents do not disclose a new soap bar holder having the features of the present invention. The inventive device includes a housing having a top wall, a back wall, a bottom wall, a front wall and a pair of side walls, the front wall having an open portion defined by a front edge of the top wall, a pair of front edges of the side walls, and a front wall bottom portion, the bottom wall having an open portion defined by a pair of bottom wall flanges, a first bottom wall flange extending inwardly from a back wall bottom edge and a second bottom wall flange extending inwardly from a front wall bottom edge, and each side wall having an inside surface, a bottom portion, a bottom edge and an opening formed proximate thereto, each opening having a top edge and being formed in such manner that each side wall bottom portion comprises a bottom wall flange outer portion. A tray having a pair of outwardly extending flanges is receivable within either opening, the outwardly extending flanges being slideable upon a pair of bottom wall flange top surfaces. A shelf is receivable within the opening and is slideable upon a top surface of the tray outwardly extending flanges. A lid having a top edge is pivotally mountable to each side wall inside surface in such manner that the lid top edge abuts the front edge of the top wall. The housing further includes a plurality of spaced partition members formed within an interior of the housing and a means for mounting the housing to a mounting surface.

In these respects, the soap bar holder according to the present invention substantially departs from the conventional concepts and designs of the prior art, and in so doing provides an apparatus primarily developed for the purpose of having a plurality of compartments, each compartment being for holding a single soap bar. A removable shelf and tray further provide a means for easily cleaning the soap bar holder.

SUMMARY OF THE INVENTION

In view of the foregoing disadvantages inherent in the known types of soap bar holders now present in the prior art, the present invention provides a new soap bar holder construction wherein the same as a plurality of compartments, each compartment being for holding a single soap bar. A removable shelf and tray further provide a means for easily cleaning the soap bar holder.

The general purpose of the present invention, which will be described subsequently in greater detail, is to provide a new soap bar holder apparatus and method which has many of the advantages of the soap bar holders mentioned heretofore and many novel features that result in a new soap bar holder which is not anticipated, rendered obvious, suggested, or even implied by any of the prior art soap bar holders, either alone or in any combination thereof.

To attain this, the present invention generally comprises a housing having a top wall, a back wall, a bottom wall, a front wall and a pair of side walls, the front wall having an open portion defined by a front edge of the top wall, a pair of front edges of the side walls, and a front wall bottom portion, the bottom wall having an open portion defined by a pair of bottom wall flanges, a first bottom wall flange extending inwardly from a back wall bottom edge and a second bottom wall flange extending inwardly from a front wall bottom edge, and each side wall having an inside surface, a bottom portion, a bottom edge and an opening formed proximate thereto, each opening having a top edge and being formed in such manner that each side wall bottom portion comprises a bottom wall flange outer portion. A tray having a pair of outwardly extending flanges is receivable within either opening, the outwardly extending flanges being slideable upon a pair of bottom wall flange top surfaces. A shelf is receivable within the opening and is slideable upon a top surface of the tray outwardly extending flanges. A lid having a top edge is pivotally mountable to each side wall inside surface in such manner that the lid top edge abuts the front edge of the top wall. The housing further includes a plurality of spaced partition members formed within an interior of the housing and a means for mounting the housing to a mounting surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new soap bar holder apparatus and method which has many of the advantages of the soap bar holders mentioned heretofore and many novel features that result in a new soap bar holder which is not anticipated, rendered obvious, suggested, or even implied by any of the prior art soap bar holders, either alone or in any combination thereof.

It is another object of the present invention to provide a new soap bar holder which may be easily and efficiently manufactured and marketed.

It is a further object of the present invention to provide a new soap bar holder which is of a durable and reliable construction.

An even further object of the present invention is to provide a new soap bar holder which is susceptible of a low cost of manufacture with regard to both materials and labor, and which accordingly is then susceptible of low prices of sale to the consuming public, thereby making such soap bar holder economically available to the buying public.

Still yet another object of the present invention is to provide a new soap bar holder which provides in the apparatuses and methods of the prior art some of the advantages thereof, while simultaneously overcoming some of the disadvantages normally associated therewith.

Still another object of the present invention is to provide a new soap bar holder having a plurality of compartments, each compartment being for holding a single soap bar.

Yet another object of the present invention is to provide a new soap bar holder which includes a housing having a top wall, a back wall, a bottom wall, a front wall and a pair of side walls, the front wall having an open portion defined by a front edge of the top wall, a pair of front edges of the side walls, and a front wall bottom portion, the bottom wall having an open portion defined by a pair of bottom wall flanges, a first bottom wall flange extending inwardly from a back wall bottom edge and a second bottom wall flange extending inwardly from a front wall bottom edge, and each side wall having an inside surface, a bottom portion, a bottom edge and an opening formed proximate thereto, each opening having a top edge and being formed in such manner that each side wall bottom portion comprises a bottom wall flange outer portion. A tray having a pair of outwardly extending flanges is receivable within either opening, the outwardly extending flanges being slideable upon a pair of bottom wall flange top surfaces. A shelf is receivable within the opening and is slideable upon a top surface of the tray outwardly extending flanges. A lid having a top edge is pivotally mountable to each side wall inside surface in such manner that the lid top edge abuts the front edge of the top wall. The housing further includes a plurality of spaced partition members formed within an interior of the housing and a means for mounting the housing to a mounting surface.

Still yet another object of the present invention is to provide a new soap bar holder that includes a tray for catching any dissolved soap and a shelf having a plurality of apertures formed therethrough, the shelf being designed to rest upon the flanges of the tray and support the soap bars within the interior of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
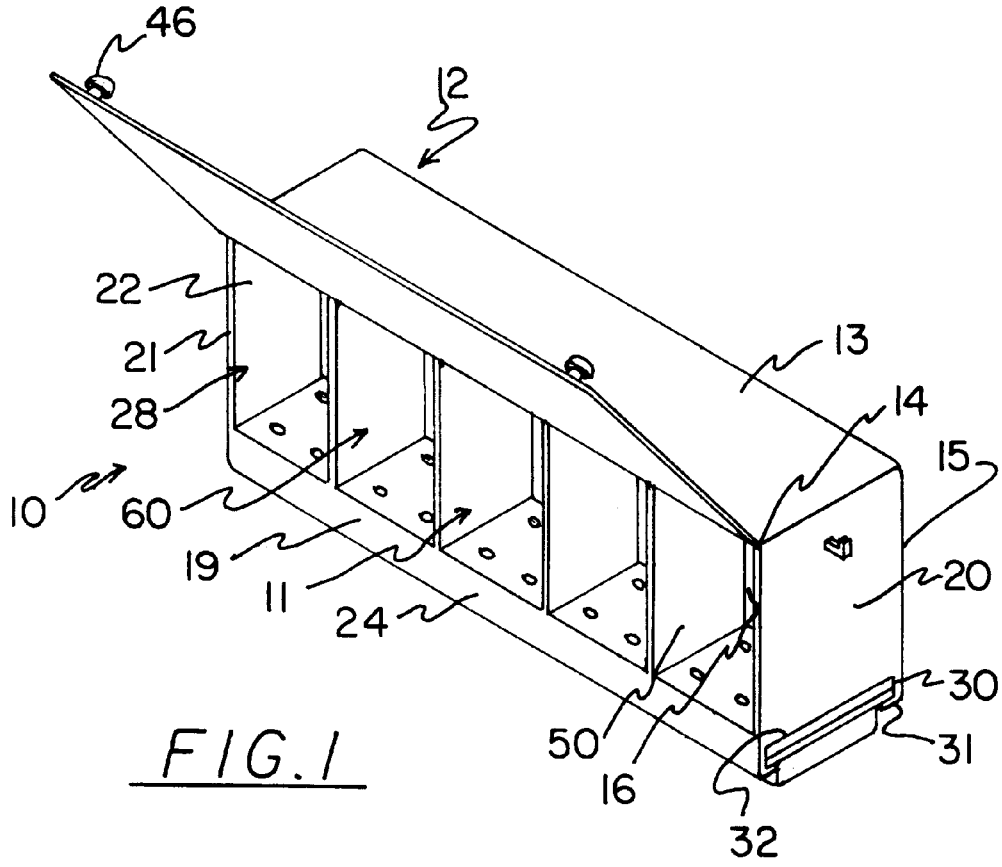
FIG. 1 is a right side perspective view of a new soap bar holder according to the present invention.

With reference now to the drawings, and in particular to FIGS. 1 through 6 thereof, a new soap bar holder embodying the principles and concepts of the present invention and generally designated by the reference numeral 10 will be described.

More specifically, it will be noted that the soap bar holder 10 comprises a housing 12 having a plurality of spaced partition members 50 formed within an interior 11 of the housing 12. While five compartments 60 are shown formed by the spaced partition members 50, any other suitable number is within the scope of the invention. A tray 36 is receivable within either of openings the 32. A shelf 40 is also receivable in either of the openings 32 and is disposed upon a top surface of a pair of tray outwardly extending flanges 37. The housing 12, tray 36, and shelf are preferably formed of a hard plastic material.

With reference to FIG. 1, the housing 12 is shown including a top wall 13, a back wall 15, a bottom wall 18 (FIG. 2), a front wall 19 and a pair of side walls 20. The front wall 19 is shown including an open portion 28 defined by a front edge 14 of the top wall 13, a pair of front edges 21 of the side walls 20, and a front wall bottom portion 24.

The bottom wall 18 is shown including an open portion 29 defined by a pair of bottom wall flanges 25, a first bottom wall flange shown extending inwardly from a back wall bottom edge 26 and a second bottom wall flange shown extending from a front wall bottom edge 27.

Each side wall includes an inside surface 22, a bottom portion 30, a bottom edge 31 and an opening 32 formed proximate the bottom edge 31. Each opening 32 includes a top edge 51 and is shown formed in such manner that each side wall bottom portion comprises a bottom wall flange outer portion 34, the top edges 51 being coplanar.

Figure 6:
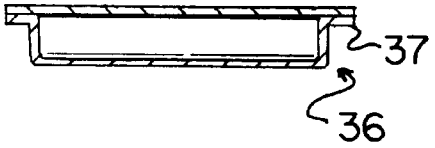
FIG. 6 is a cross sectional view taken along line 6—6 of FIG. 3.

With reference to FIG. 6, the tray 36 includes a pair of outwardly extending flanges 37. In use, the tray 36 is receivable within either opening 33, the outwardly extending flanges 37 being slideable upon a pair of bottom wall flange top surfaces 35 (FIG. 2).

Figure 4:
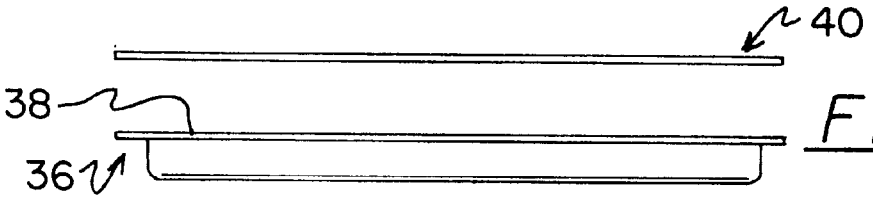
FIG. 4 is a side elevation view of the tray and shelf of the present invention.
Figure 5:
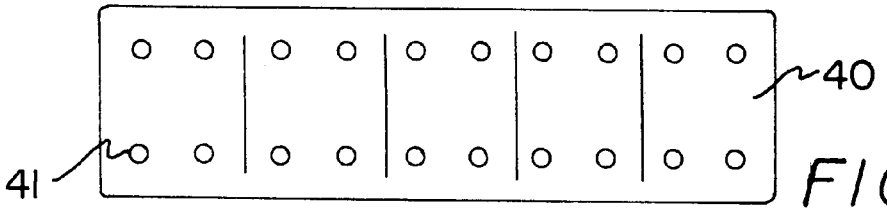
FIG. 5 is a plan view of the shelf.

With reference to FIGS. 4, 5, and 6 the shelf 40 is shown including a plurality of spaced apertures 41 formed therethrough. In use, the shelf 40 is receivable within either opening 32 and is disposed in slideable relationship to the tray 36 is such manner that the shelf slides upon a top surface 38 of the tray outwardly extending flanges 37. The soap bars disposed within the compartments 60 are supported therein by the shelf 40. Any dissolved soap flows through the spaced apertures 41 and into the tray 36. The tray 36 and shelf 40 are easily removed from the housing 12 for cleaning.

Figure 2:
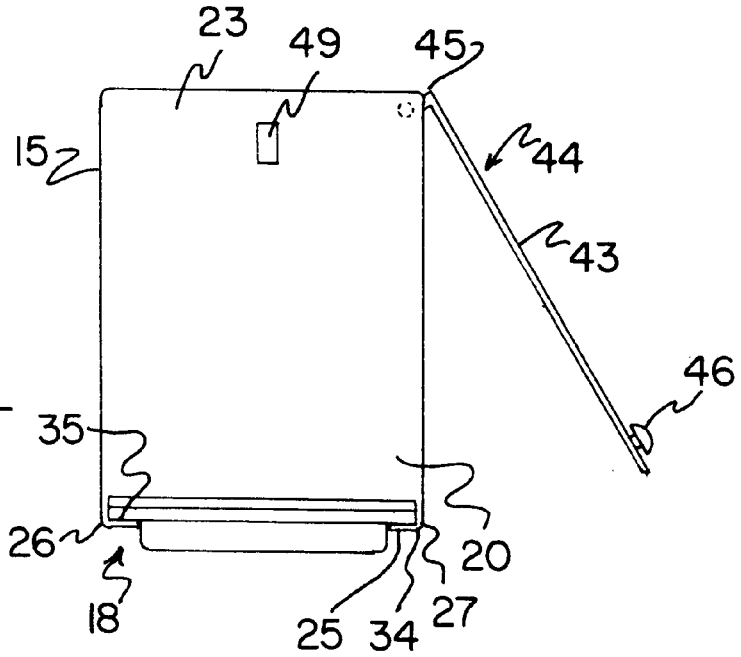
FIG. 2 is a side elevation view thereof.

With reference to FIGS. 1 and 2, a lid 44 is shown pivotally mounted to each side wall inside surface 22 in a conventional manner. The lid 44 includes a top edge 45 which is shown in abutting relationship to the front edge 14 of the top wall 19. The lid 44 is sized and configured to cover the front wall 19 of the housing 12 and thereby keep water from entering the interior 11 of the housing 12.

The partition members 50 are shown in FIG. 1 and extend from an inside surface 16 of the back wall 15 to a plane formed by the front wall bottom portion 24, and from an inside surface of the top wall (not shown) to a position proximate a plane formed by the top edges 51 of the openings 32. In such manner the tray 36 and shelf 40 can freely slide through the openings 32.

Figure 3:
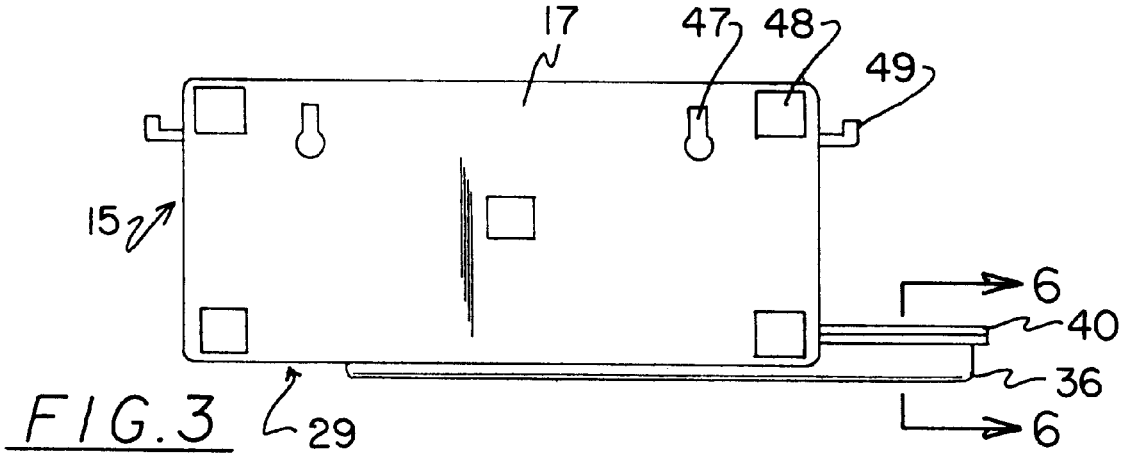
FIG. 3 is a rear elevation view thereof.

The soap bar holder 10 can easily be mounted to a mounting surface such as a wall by means of a plurality of spaced, water-resistant, two-sided adhesive means such as tape shown adhered to an outside surface 17 of the back wall 15 (FIG. 3). Alternatively, a pair of spaced slots 47 are shown formed through the back wall 15. Each slot 47 is designed for receiving the head of a screw (not shown) attached to the mounting surface.

A peg 49 is shown formed to an outside surface 23 of each side wall 20. The pegs 49 serve as a means for hanging a wash cloth or the like.

A pair of spaced apart knobs 46 are shown attached to a outer surface 43 of the lid 44.

In use, the housing 12 is mounted to a mounting surface such as a wall in a shower stall by means of either the adhesive means 48 or the slots 47. The tray 36 is inserted in either opening 32 and positioned within the interior 11 of the housing 12. Similarly, the shelf 40 is inserted in either opening 32 in such manner that it is disposed upon a top surface 38 of the tray outwardly extending flanges 37. The lid 44 is opened for placement of the soap bars in the compartments 60 and closed to keep water from entering the housing 12. To clean the soap bar holder 10, the soap bars are removed from the compartments 60 and the tray 36 and shelf 40 are removed from the opening 32 and separately cleaned.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A soap bar holder comprising:

a housing having a top wall, a back wall, a bottom wall, a front wall and a pair of side walls, the front wall having an open portion defined by a front edge of the top wall, a pair of front edges of the side walls, and a front wall bottom portion, the bottom wall having an open portion defined by a pair of bottom wall flanges extending inwardly from a back wall bottom edge and a front wall bottom edge, and each side wall having an inside surface, a bottom portion, a bottom edge and an opening formed proximate thereto, each opening having a top edge and being formed in such manner that each side wall bottom portion comprises a bottom wall flange outer portion;

a tray having a pair of outwardly extending flanges, the tray being receivable within the opening, the outwardly extending flanges being slideable upon a pair of bottom wall flange top surfaces;

a shelf receivable within the opening and slideable upon a top surface of the tray outwardly extending flanges;

a lid having a top edge, the lid being pivotally mountable to each side wall inside surface in such manner that the lid top edge abuts the front edge of the top wall;

a means for mounting the housing upon a mounting surface; and wherein the housing further comprises a plurality of spaced partition members formed within an interior of the housing.

2. The soap bar holder of claim 1, wherein the partition members extend from an inside surface of the back wall to a plane formed by the front wall bottom portion, and from an inside surface of the top wall to a position proximate a plane formed by the top edges of the openings.

3. The soap bar holder of claim 1, wherein the shelf further comprises a plurality of spaced apertures formed therethrough.

4. The soap bar holder of claim 1, wherein the means for mounting the housing upon a mounting surface further comprise a plurality of spaced, water-resistant, two-sided adhesive means adhered to an outside surface of the back wall.

5. The soap bar holder of claim 1, wherein the means for mounting the housing upon a mounting surface further comprise a pair of spaced slots formed through the back wall, each slot being for receiving the head of a screw attached to the mounting surface.

6. The soap bar holder of claim 1, wherein each side wall further comprises an outer surface, each outer surface further comprising an integral peg.

7. The soap bar holder of claim 1, wherein the lid further comprises an outer surface, the outer surface further comprising a pair of spaced apart knobs.

* * * * *